US006089978A

United States Patent [19]

Adams

[11] Patent Number: 6,089,978

[45] Date of Patent: Jul. 18, 2000

[54] METHOD OF PLAYING GAME AND GAMING GAMES WITH AN ADDITIONAL PAYOUT INDICATOR

[75] Inventor: William R. Adams, Las Vegas, Nev.

[73] Assignee: Anchor Gaming, Las Vegas, Nev.

[21] Appl. No.: 09/157,994

[22] Filed: Sep. 22, 1998

Related U.S. Application Data

[63] Continuation-in-part of application No. 08/907,764, Aug. 8, 1997, Pat. No. 5,848,932, and a continuation-in-part of application No. 08/311,783, Sep. 23, 1994, abandoned.

[51] Int. Cl.[7] ..... A63B 59/00

[52] U.S. Cl. ..... 463/20; 273/143 R

[58] Field of Search ..... 273/143 R, 138 A, 273/318 R, 138.2, 138.1; 463/20

[56] References Cited

U.S. PATENT DOCUMENTS 5,848,932 12/1998 Adams ..... 463/20

FOREIGN PATENT DOCUMENTS 2072395A 8/1981 United Kingdom ..... 273/143 R
2083936A 3/1982 United Kingdom ..... 273/138 A
2182186A 5/1987 United Kingdom ..... 273/143 R

*Primary Examiner*—Jeanette Chapman
*Assistant Examiner*—Raeann Gorden
*Attorney, Agent, or Firm*—Galgano & Burke

[57] ABSTRACT

Gaming devices comprising a standard gaming unit, e.g., three reels, and a discernible additional payout indicator, e.g., a rotatable wheel. A preferred bonus payout indicator is clearly visible by the player and is actuatable when the reels of the slot machine stop on certain predetermined indicia. A preferred embodiment further comprises a payout multiplier which displays a plurality of values by which a payout may be multiplied.

7 Claims, 6 Drawing Sheets

METHOD OF PLAYING GAME AND GAMING GAMES WITH AN ADDITIONAL PAYOUT INDICATOR

RELATED APPLICATION DATA

This application is a continuation-in-part of U.S. patent application Ser. No. 08/907,764 filed on Aug. 8, 1997, now U.S. Pat. No. 5,848,932 which is a continuation-in-part of U.S. patent application Ser. No. 08/311,783 filed on Sep. 23, 1994, now abandoned.

The present invention is directed to novel gaming devices and, more particularly, to gaming devices comprising at least primary and secondary events capable of providing at least one of a plurality of payouts.

BACKGROUND OF THE INVENTION

Games of chance have been enjoyed by people for years and have enjoyed widespread popularity in recent times.

Many people enjoy playing a wide variety of games that they have not played before. Playing new games adds to the excitement of this recreational activity particularly when some form of "gaming" is involved. As used herein, the term "gaming" and "gaming devices" are used to indicate that some form of wagering is involved, and that players must make wagers of value, whether actual currency or some equivalent of value, e.g., token or credit.

One popular game of chance that has long been enjoyed by many players is the slot machine. Conventionally, a slot machine is configured for a player to input something of value, e.g., a standard denomination of currency or house token or other representation of currency or credit, and then to permit the player to activate the device which causes a plurality of reels to spin and ultimately stop to display a random combination of some form of indicia, for example, numbers or symbols. If this display contains one of a preselected plurality of winning combinations, the machine releases money into a payout chute or onto a credit meter for the player. For example, if a player initially wagered two coins of a national currency and that player won a high payout, that player may receive fifty coins of the same denomination in return.

Since it is desirable to offer players games which they have not played before, it would be desirable to provide a player with new games and additional opportunities to receive winning payouts.

Those familiar with games involving winning payouts, such as the popular television game show entitled "WHEEL OF FORTUNE" will realize that as players and observers watch a large wheel spin and gradually come to rest, the players experience a heightened feeling of anticipation and excitement as the wheel is slowing down to indicate a possible prize.

It would therefore also be desirable to provide a payout indicator which is discernible by a player and/or other observers.

SUMMARY OF THE INVENTION

Various embodiments of the present invention comprise methods of playing games, gaming devices and table games utilizing a primary game, e.g., rotatable reels, and at least one discernible indicia of a secondary game, preferably comprising a payout indicator. The secondary game is separate from the primary game either physically or temporally.

According to the most preferred embodiments, a bonus payout indicator is clearly visible to a player and is operable when primary reels of a primary game slot machine stop on certain predetermined indicia. According to one preferred embodiment of the present invention, a secondary payout indicator is in the form of a rotatable bonus wheel which can be caused to spin automatically or in response to some action by a player, e.g., the player pushing a button, when the primary game indicates one of a predetermined plurality of indicia. The wheel is caused to gradually reduce speed and when the wheel stops, a pointer indicates the payout to be awarded to the player.

Another preferred embodiment of the present invention further comprises a discernible multiplier which provides the ability to change either the payout from the primary gaming unit or the secondary payout indicator, or both. As described in more detail below, it is within the scope of the present invention to provide a payout from the primary gaming unit, a payout indicated by the secondary indicator only, a payout from the primary gaming unit or the secondary indicator as changed by the multiplier, or a separate, plurality of payouts from the primary gaming unit and the secondary indicator either with or without modification by a multiplier.

According to one preferred embodiment of the present invention, the mechanical bonus payout indicator is electronically operated and is linked to a random number generator which determines where the secondary indicator actually stops.

According to another preferred embodiment of the present invention, when the primary unit stop on one of a predetermined plurality of winning indicia sets, a second event actuator is placed in an active state. According to this embodiment, a person, such as the player, must actuate the actuator in order to operate the bonus indicator.

According to another embodiment of the present invention, the bonus actuator requires operator intervention so that a player must involve a casino attendant who can activate the bonus indicator.

According to another preferred embodiment of the present invention, the bonus indicator is connected to a drive mechanism which gradually reduces the rate of spin of the bonus wheel before the bonus wheel stops.

Still other embodiments of the present invention comprise gaming devices having electronic means for displaying indicia of rotatable reels such as a video screen and/or means for displaying indicia of a secondary payout indicator, such as a video screen. The present invention also comprises methods for playing a game of chance. One preferred method comprises the steps of displaying a first randomly selected combination of indicia, said displayed indicia selected from the group consisting of slot reels, indicia of at least one reel, indicia of at least one playing card, and combinations thereof; generating at least one signal corresponding to at least one select display of first indicia; providing at least one discernible indicia of a mechanical bonus indicator, said bonus indicator indicia indicating at least one of a plurality of possible payouts, wherein said bonus indicator indicia providing means is operatively connected to said first, standard gaming unit and actuatable in response to said signal. According to one preferred embodiment, the discernable indicia of a mechanical bonus indicator gradually reduces the rate of movement of the mechanical bonus indicator for some period of time prior to actually providing the discernable indicia of a payout. According to another embodiment, a multiplier is provided to multiply at least one payout by a multiple which is most preferably indicated to a player. The multiple can preferably sequentially change as discernable indicia change. For example, a plurality of multiples can be synchronized with a plurality of discernable indicia on the mechanical bonus indicator such that the multiple changes as the payout indicated changes.

Further embodiments of the present invention comprises a method of conducting a game of chance comprising the steps of providing a player with an opportunity to place a wager; displaying a randomly selected combination of indicia, said displayed indicia selected from the group consisting of reels, indicia of at least one and preferably a plurality of reels, indicia of at least one and preferably a plurality of playing cards, and combination thereof; generating at least one signal corresponding to at least one select display of said indicia; providing at least one discernible indicia of a mechanical bonus indicator, said bonus indicator indicia indicating at least one of a plurality of possible bonuses, wherein said bonus indicator indicia is in the form of a wheel or reel and is actuatable in response to said signal.

According to another embodiment of the present invention, the secondary gaming unit is in the form of a simulated bowling-type game. According to this embodiment of the present invention, a player's payout is determined, at least in part, by the randomly determined outcome of a simulated bowling game.

DETAILED DESCRIPTION

Figure 1:
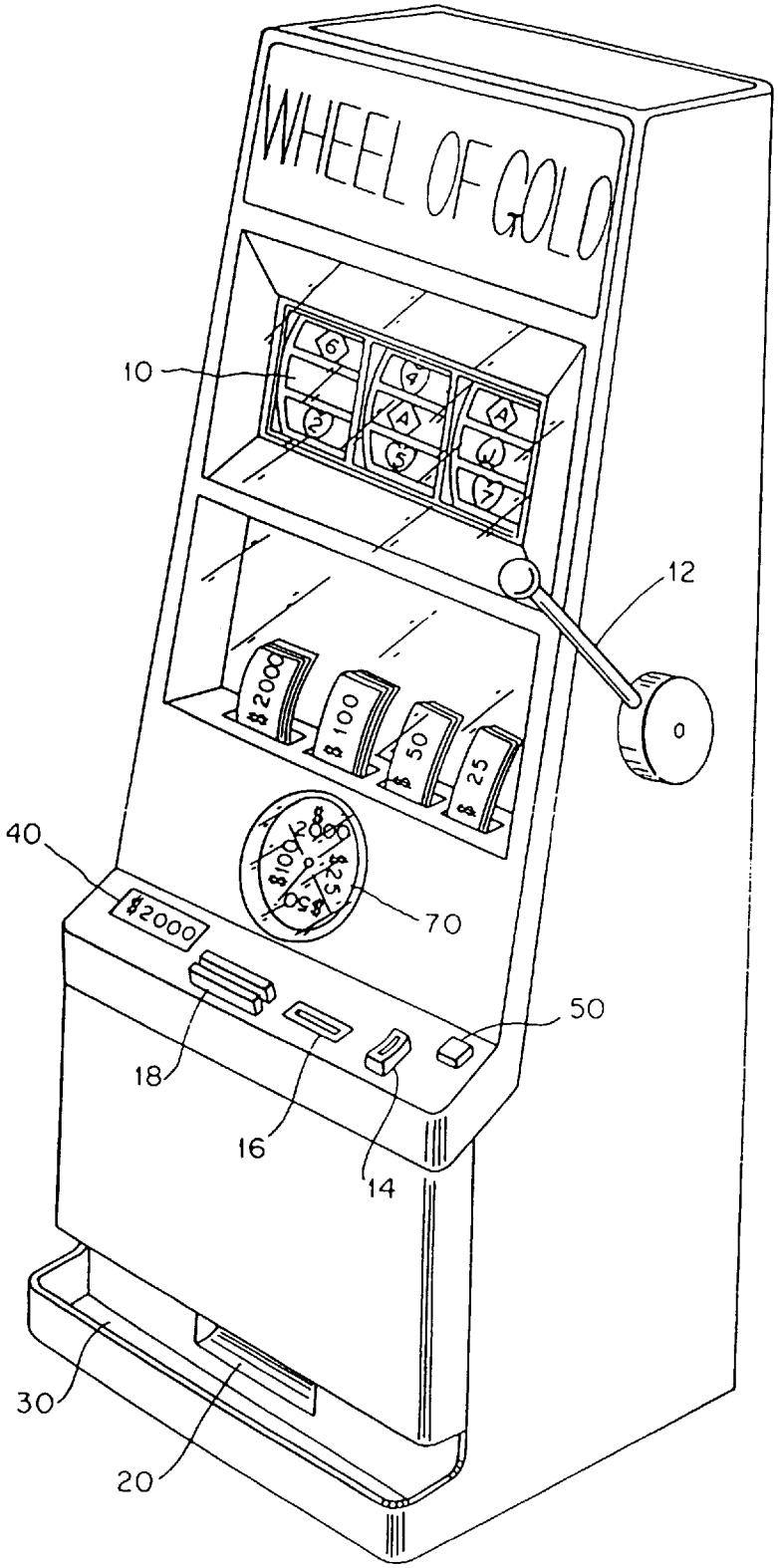
FIG. 1 is a perspective view one of a gaming device of one embodiment of the present invention.

The various embodiments of the present invention are designed to provide added excitement to a board/table game or gaming device in order to increase the enjoyment of players and to serve as an added attraction to potential players. On preferred embodiment of the present invention, illustrated in FIG. 1, comprises a primary gaming unit which comprises three rotatable reels 10, each of which comprise a plurality of indicia on the periphery thereof. The illustrated gaming device comprises a mechanical lever 12, coin slot 14, currency validator 16 and a credit card validator 18. In a manner which will be recognized by those skilled in the art, each reel 10 is designed to rotate and then stop in order to visually display at least one, and preferably a number of indicia. If the collection of indicia displayed by the three reels is one of a predetermined plurality of winning indicia sets, then the player can typically be provided with a winning payout either through coin chute 20 which deposits winnings into a coin trough 30 or by increasing the player's credits in a credit window 40.

Figure 2:
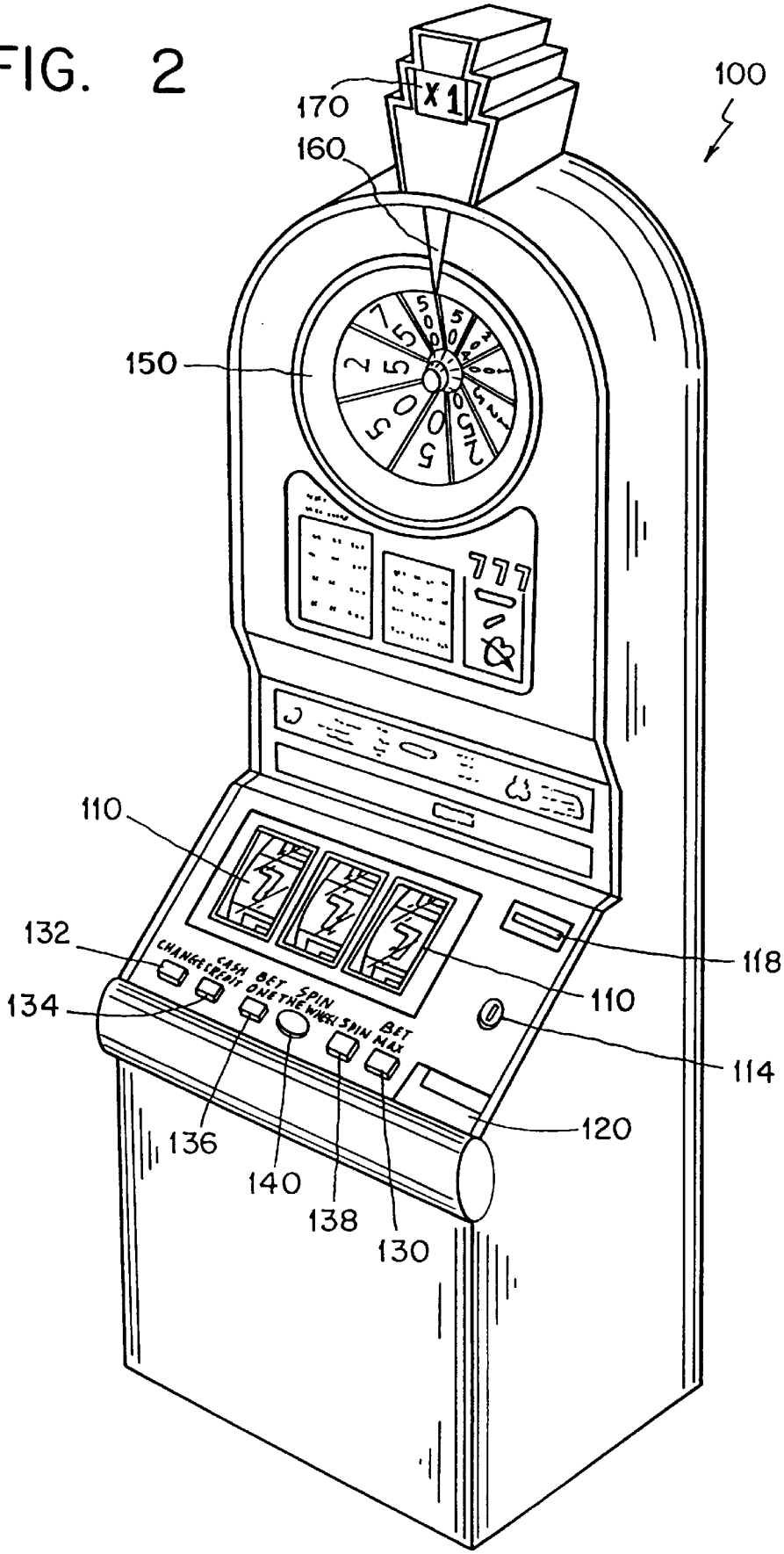
FIG. 2 is another embodiment of a gaming device of the present invention.

According to one aspect of the present invention, when the reels 10 display at least one of a plurality of predetermined winning indicia or indicia sets then the player is provided with an opportunity for a secondary payout. According to this illustrated embodiment of the present invention, a bonus actuator button 50 is placed in an operative state when reels 10 display a bonus indicia set. A player must then depress bonus actuator 50 in order to start bonus indicator 70 spinning. In the illustrated embodiment, bonus indicator 70 is in the form of a rotatable wheel. The wheel may be a carnival-type wheel comprising pegs and a clapper or could take one or more other forms, such as a fanciful wheel typically used in a roulette game as shown in the embodiment of FIG. 2. If a preferred motor driven wheel is utilized, it is preferably linked to some random value generator in order to randomly determine where the wheel will actually stop. In order to enhance the playing experience, sound effects corresponding to a clapper slapping against pegs of a carnival wheel are preferably provided as the wheel passes from one segment to another. The bonus indicator 70 is also preferably controlled so that the rate of spin is reduced, most preferably gradually reduced, prior to stopping in order to simulate a mechanical spinning wheel.

The facing surface of bonus indicator 70 of FIG. 1 comprises four distinct areas bearing indicia of the bonus payout to the player. In the illustrated embodiment, the bonus indicator has areas indicating bonuses of $25.00, $50.00, $100.00, and $2,000.00. When bonus indicator 70 stops, an indicator (not shown) will indicate the area on the bonus wheel corresponding to the amounts of the bonus to be provided to the player.

In a manner which will be appreciated by those skilled in the art, bonus indicator 70 can be operatively linked to a "payout" mechanism which provides a bonus payout to a player through currency chute 20 or by increasing the amount of winnings shown in credit window 40. As stated above, the payout of the bonus indicator can be in addition to a standard payout by the primary gaming unit or can be in place of the payout normally associated with the primary gaming unit.

Those familiar with gaming and game shows, will appreciate that players and observers typically experience a heightened level of anticipation and excitement as they observe one or more moving objects approaching a winning position. It is therefore most preferred for the bonus indicator of the present invention to be readily discernible, e.g., clearly visible and/or audible to the player.

According to another preferred embodiment of the present invention, a bonus indicator is connected to a electronic control unit, for example a motor, which gradually decreases the rate of movement of the bonus indicator before the bonus indicator stops. According to this embodiment of the present invention, players can be provided with a realistic sense of a totally mechanical indicator. Those skilled in the art will appreciate that such a control unit can also readily be connected to a random generator which will randomly select the winning payout according to a predetermined frequency of occurrence for each. individual bonus payout, and then cause the bonus indicator to stop at the desired area. Those skilled in the art will also appreciate that other mechanisms can be utilized for gradually decreasing the rate of movement of the secondary payout indicator, e.g., a controlled braking system.

According to another embodiment of the present invention, when reels 10 display an indicia set which will provide a bonus, the bonus indicator becomes activatable but requires intervention by a house attendant, such as a casino attendant, in order to actuate the bonus indicator.

According to this embodiment of the present invention, the casino is provided with greater control over the actuation of the bonus indicator and, if desired, can accompany the actuation of the bonus indicator with great fanfare. It will be appreciated that the amounts of the bonus indicated in the figures are merely for purposes of illustration and, if desired, one of the amounts on the bonus indicator can have a significantly greater value. For example, one of the areas on the bonus indicator may correspond to a new automobile, a luxury vacation or a very large sum of money.

While the illustrated embodiment of the present invention in FIG. 1 is generally in the form of a rotatable wheel, other visible, mechanical indicia can be provided, whether controlled totally mechanically, electro-mechanically, or electronically without departing from the scope of the present invention.

As shown in FIG. 1, in order to provide additional levels of excitement, indicia of the possible bonuses are preferably visibly displayed within the slot machine. For example, in one illustrated embodiment, a shelf is preferably displayed comprising piles of currency equal to the amounts on the bonus indicator. While actual cash is preferred, the slot machine may also be provided with fake currency or simply indicia of actual currency or the other bonus prizes.

A preferred embodiment of the present invention is illustrated in FIG. 2 wherein a gaming device 100 comprises a primary gaming unit in the form a standard three-reel slot machine which displays reels 110. Suitable controls and currency mechanisms including a coin slot 114, bill validator 118, payout shoot 120 are provided. Furthermore, suitable player controls including CHANGE button 132, CASH/CREDIT button 134, BET ONE button 136, SPIN button 138 and BET MAX button 130 are also provided.

In addition to these standard controls the control panel of this preferred illustrated embodiment of the present invention comprises a SPIN THE WHEEL button 140 which becomes actuatable when the primary gaming unit, as indicated by reels 110, has randomly selected one of a plurality of predetermined indicia sets. While the primary gaming unit shown in the lower portion of the cabinet of gaming device 100 will typically have the ability to provide a plurality of winning payouts, the SPIN THE WHEEL button 140 can become actuatable when the stopped reels 110 indicate some subset of the primary unit's winning indicia, when any one of the winning reel indicia are displayed, or further in response to one or more other predetermined indicia, or a combination thereof. For example, the SPIN THE WHEEL feature, or some other secondary game, can be actuated or become activatable in response to a single indicia indicated on one of the reels or reel indicia.

When the SPIN THE WHEEL button 140 is actuated by a player, bonus wheel 150 is caused to rotate and randomly select and display one of a plurality of different areas. According to the preferred illustrated embodiment, all of the bonus areas indicate an increased winning value for the player. However, it is within the scope of the present invention to provide non-monetary prizes or losing spaces wherein no additional prize is provided and/or wherein the prize normally associated with the indicia shown on the primary gaming unit reels 110 is reduced. In the illustrated embodiment, a pointer 160 advantageously indicates the result of the bonus wheel 150.

In addition to the bonus wheel 150, this preferred illustrated embodiment of the present invention also comprises a bonus multiplier 170. The multiplier 170 preferably randomly selects a value by which the bonus indicated by bonus wheel 150 is multiplied. For example, the bonus multiplier 170 can have an LED screen which cycles through multipliers of "times one", "times two" and "times three" which will indicate that the bonus is as indicated, doubled, or tripled, respectively. The multiplier 170 can be programmed to select a multiplier either totally randomly or according to some other predetermined frequency of occurrence wherein certain multipliers will occur more frequently than other multipliers. While this illustrated embodiment comprises whole number multipliers, it is also within the scope of the present invention to utilize values other than whole numbers or to include multipliers which will result in a decrease in the value shown by the bonus indicator 150. For example, a multiplier sequence could include a "times zero" value. When bonus wheel indicator 150 is not in use, the multiplier LED window can be set to an attract mode wherein a message is displayed to players or potential players. For example, the LED display could show a message, either in complete form or can be set to sequentially display either words or individual letters, such as "S P I N - T H E - W H E E L".

According to the various embodiments of the present invention, the bonus multiplier or additional payout multiplier is most preferably synchronized with the movement of the rotatable wheel or indicia of a rotatable reel, such that the multiplier value will change as each wheel segment passes the indicator. The most preferred embodiments of the present invention additionally comprise audible signals, such as the clicking of a clapper of the type found on actual spinning wheel comprising a clapper indicator and pegs which strike the clapper. The audible signals are preferably also synchronized with the segments of the wheel such that an audible signal is provided as the wheel moves from one segment to another. This advantageously provides the effect of a mechanical wheel comprising pegs moving past a mechanical clapper.

Figure 3:
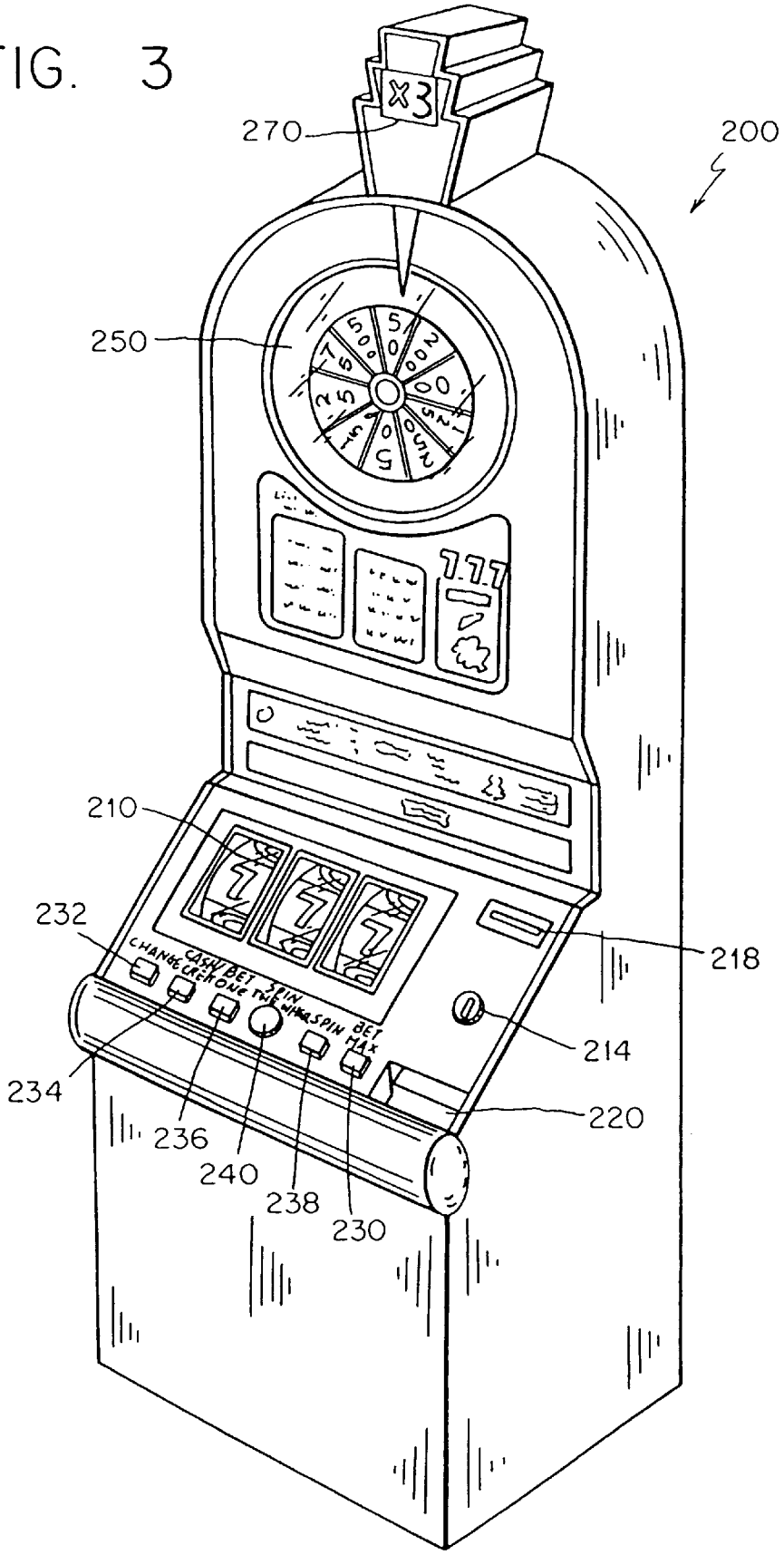
FIG. 3 illustrates an alternative embodiment of the present invention.

FIG. 3 illustrates a less preferred embodiment of the present invention wherein a gaming device 200 comprising similar controls as the controls illustrated in the embodiment of FIG. 2. In this illustrated embodiment, and wherein a bonus indicator 250 is in the form of an electronically generated image, such as a video screen or an LED display and provides discernible indicia, e.g., a visual video display, of a bonus wheel. For example, the video display can show a wheel of the type used in a roulette game such as the wheel 150 illustrated in FIG. 2.

The slot machine shown in FIG. 3 comprises a video display 210, such as a video screen, which displays indicia of three reels 110, each of which comprise a plurality of indicia. In addition, this slot machine comprises a video display 250, such as a second video screen, for displaying a bonus payout indicator. While separate screens are preferred, both the reels and the bonus payout indicator could be displayed on the same video screen. According to this embodiment of the present invention, the bonus payout indicator displays indicia of a wheel or a reel.

In a manner known in the art, the gaming device comprises a coin slot 214, a currency validator 218, and a coin chute 220. After placing a wager, a player determines the amount of his wager by either pressing the BET ONE button 236 or the BET MAX button 230. After the player has selected the amount of his wager, he depresses the SPIN button 238 which "spins" the reels shown in video display window 210.

Each indicia of a displayed reel 210 is designed to indicate rotation and then stop in order to visually display at least one, and preferably a number of indicia. When reels 210 display a particular indicia set or one of a predetermined plurality of indicia sets, then the additional payout mode is activated and video display 250 displaying payout indicator is placed in an operable state. In this illustrated embodiment, the displayed payout indicator 250 displays an indicia of a rotating wheel comprising a plurality of distinct areas bearing indicia of payouts to the player. Payout indicator 250, is caused to selectively indicate one of the plurality of indicia, either automatically, upon intervention of a casino or house attendant, or upon a player depressing SPIN THE WHEEL button 240 in order to start indicator 250 spinning. It will be appreciated that the amounts of the payout indicated in FIG. 3 are merely for purposes of illustration and, if desired, one of the amounts on the bonus indicator can have a greater value, e.g., a new automobile, a luxury vacation or large sum of money which may be collected subsequently, or lesser values, e.g., no payout.

The displayed reels 210 and displayed bonus indicator 250 can be operably controlled by suitable controls to gradually slow down as they come to a complete stop, displaying a selected reel indicia and a bonus indicia, respectively.

The embodiment of the present invention illustrated in FIG. 2 is considered most preferable since it is believed that players prefer to see actual slot reels and an actual bonus wheel spinning in a gaming device. Other, less preferred embodiments are also possible while providing some of the advantages of the present invention. Specifically, it is feasible to replace the spinning reels with other forms of standard gaming units, for example, a visible indicia of reels or indicia of playing cards, shown for example on a video screen. It is also possible to replace the wheel with some other discernible indicia of a mechanical bonus indicator which is operatively connected to the first standard gaming unit and which either automatically commences or is actuatable in response to the result provided by the standard gaming unit. According to the present invention, both of the standard gaming unit and bonus indicator are controlled to provide random results.

From the foregoing description, it will be appreciated that embodiments of the present invention, which are specifically directed to gaming and gaming devices, comprise three different indicators. The most preferred embodiments comprise a primary (standard) gaming unit, an additional payout indicator, preferably in the form of a wheel, and a payout multiplier. While the illustrated payout multiplier of the illustrated embodiments is in the form of an electronically selected value, it is also within the scope of the present invention to have a multiplier which involves some skill on the part of a player. For example, according to an additional preferred embodiment of the present invention, a player will shoot actual projectiles, such as coins, at one or more targets in an effort to increase the value of the multiplier. In any of the embodiments of the present invention utilizing a multiplier, the multiplier can affect the value of a payout from the standard gaming unit, the additional payout indicator, or both the standard gaming unit and the payout indicator.

As stated above, the present invention also includes methods of conducting a wagering game of chance comprising the steps of providing a player with an opportunity to place a wager; displaying a randomly selected combination of indicia, said displayed indicia selected from the group consisting of reels, indicia of reels, indicia of playing cards, and combination thereof; generating at least one signal corresponding to at least one select display of said indicia; providing at least one discernible indicia of a mechanical bonus indicator, said bonus indicator indicia indicating at least one of a plurality of possible bonuses, wherein said bonus indicator indicia is in the form of a wheel or reel and is actuatable in response to said signal. A further preferred method comprises the step of displaying at least one value by which a payout may be multiplied.

Another method of the present invention comprises the steps of requiring at least one player to make a wager; displaying at least one randomly selected playing card from a predetermined card indicia set; displaying and rotating a rotatable wheel comprising a plurality of indicia corresponding to a plurality of prizes if said displayed playing card indicia was one of a preselected plurality of winning card indicia; and determining a winning payout with said wheel, wherein said winning payout is randomly selected.

Figure 4:
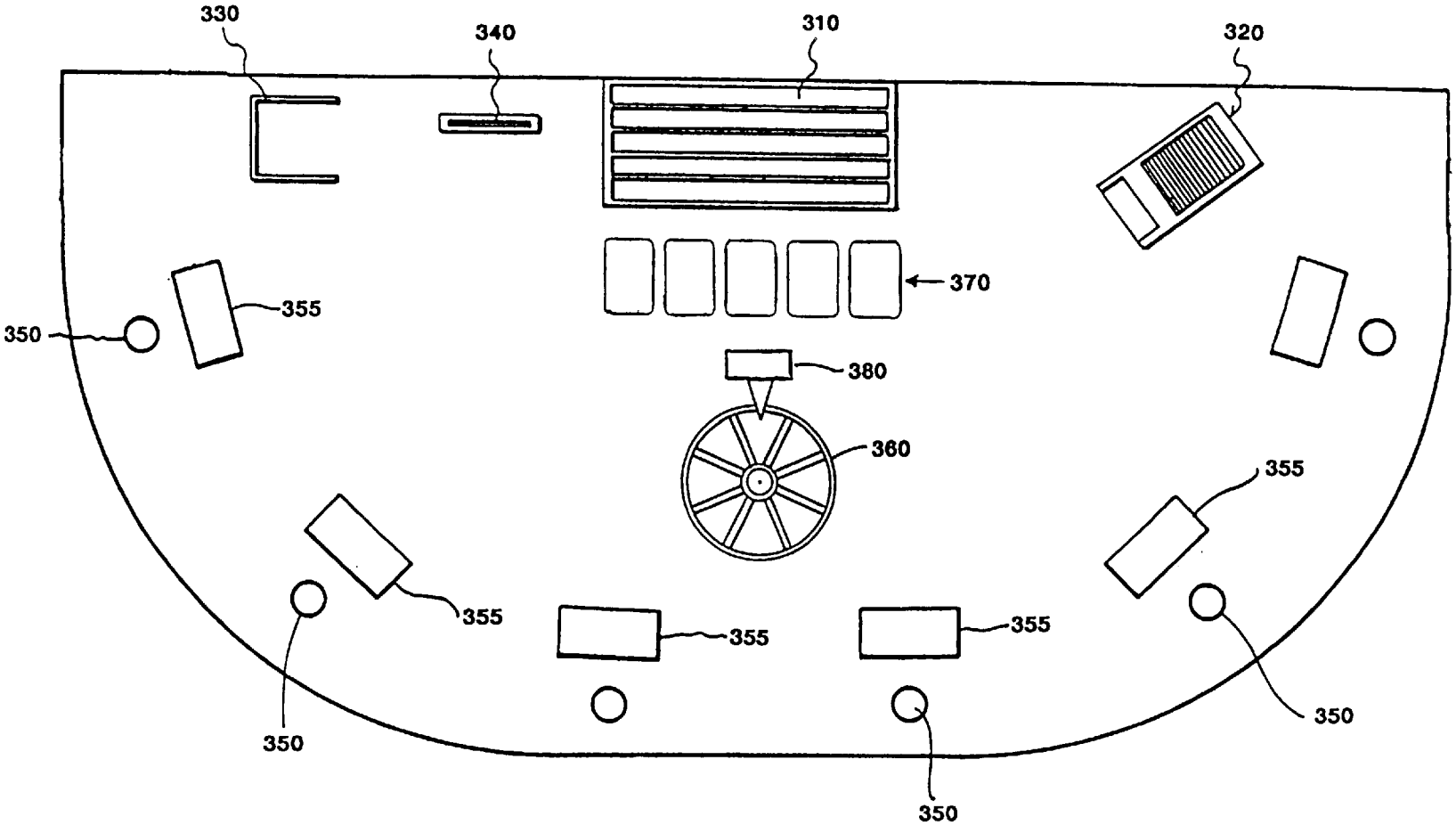
FIG. 4 is an alternative embodiment of the present invention in the form of a table game.

Another embodiment of the present invention in the form of a table game is illustrated in FIG. 4 wherein a chip rack 310, card shoe 320, discard shoe 330, wager slot 340, betting areas 350, and secondary event wheel 360 are provided. According to this embodiment of the present invention after one or more players have placed wagers in wagering areas 350, a dealer will provide cards to the wagering players in areas 355 and then provide cards to himself in card area 370. After the cards have been dealt, the initial bets can be resolved by comparing the players' cards to the dealer's cards. While the illustrated game is shown as five card stud poker, other games and arrangements can also be utilized without departing from the scope of the present invention. For example, a player's cards can be compared to other player's cards or a predetermined payout schedule, or other card games can be utilized including seven card draw, five card draw poker, black jack, etc.

Upon the happening of a predetermined occurrence, such as the receipt of one of a preselected plurality of card hands, one or more of the players can be given the-opportunity to spin the payout indicator 360, which is most preferably electronically operated by an actuation switch. The actuation switch can be within reach of the players for added excitement or can be actuated by the dealer. Alternatively, actuation by a player's actuator switch can require prior actuation of a dealer switch which will then render the player's switch operable. If less than all of the players are going to benefit from the results of payout indicator 360, additional indicators can be positioned proximate the players in order to indicate which players are involved in the spin of payout indicator 360. In a manner similar to that shown in FIG. 2, a payout multiplier 380 is also provided. Sound effects as referenced above and means for gradually decreasing the rate of movement of the payout indicator 360 are also preferably provided.

In addition to the primary gaming unit or primary game, the secondary event, and the multiplier, another preferred aspect of the present invention which can be utilized with all previously described embodiments comprises a DOUBLE-OR-NOTHING feature wherein winning players may wager their winnings in a double-or-nothing fashion. According to this feature of the present invention, a player may be provided with the opportunity to bet on red or black after he has won a game. For this purpose, the rotatable wheels of the present invention are preferably provided with alternating red and black pie-shaped segments. According to this feature, a player can be provided with the opportunity of betting on red or black with the opportunity of doubling his winnings if he makes a correct selection. After the player makes his selection, the wheel would be rotated to determine whether the player has successfully doubled his winnings or has lost those winnings. A player may be provided with the opportunity of utilizing the double or nothing feature several times and/or up to a certain maximum to be determined by the game operator.

Figure 5:
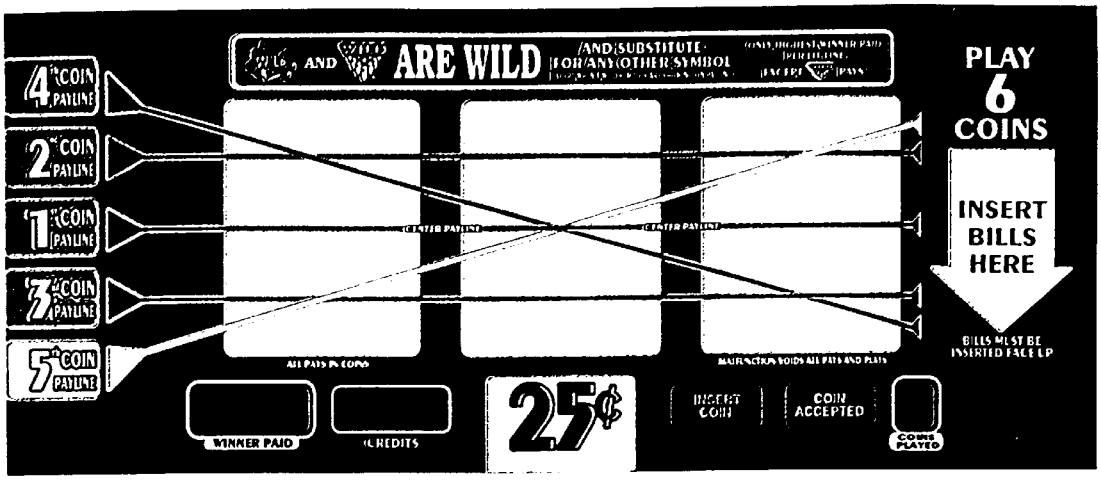
FIG. 5 illustrates a three reel display of a bowling-type embodiment of the present invention.
Figure 6:
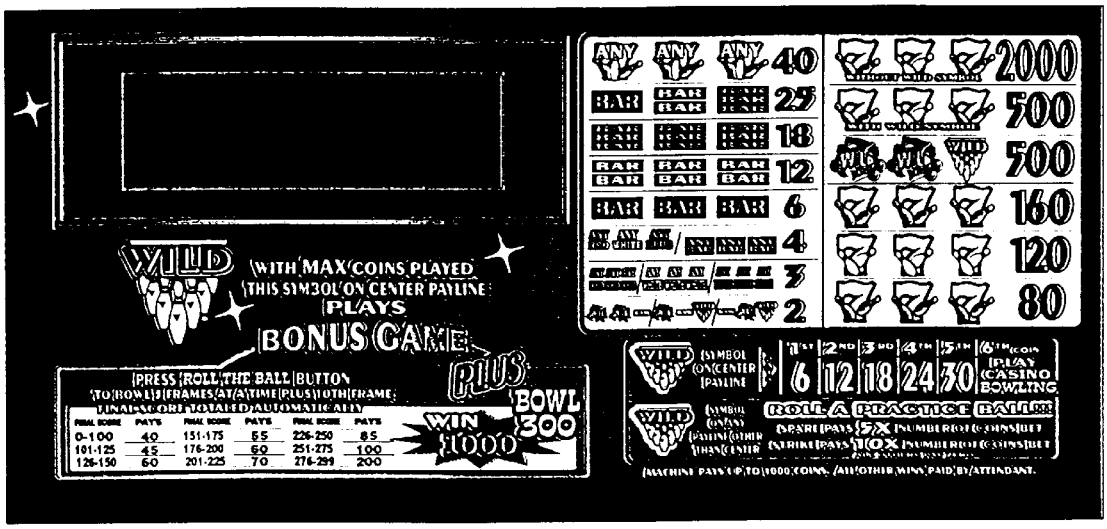
FIG. 6 illustrates a display screen and payout schedules for a bowling-type game of the present invention
Figure 7:
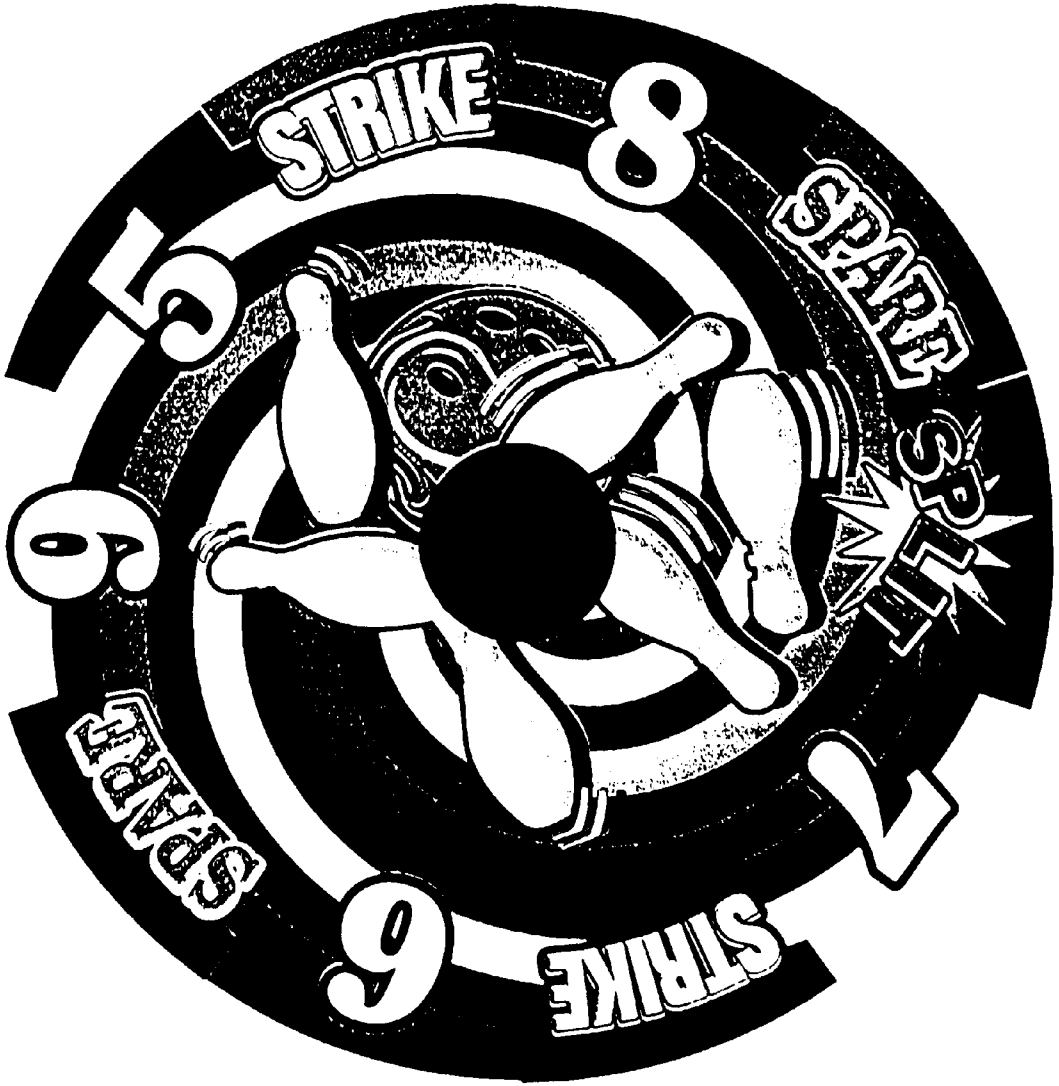
FIG. 7 illustrates a rotatable display of a secondary gaming unit which simulates a bowling-type game.

According to another embodiment of the present invention, the primary gaming unit is in the form of a three reel slot machine, while the secondary gaming unit simulates a bowling game. According to this embodiment which is illustrated in FIGS. 5–7, a player can wager from 1–5 coins. The primary reel slot machine is provided with 5 separate paylines, as illustrated in FIG. 5 which are activated depending upon the number of coins wagered by the player.

Therefore, a single coin will obtain a single payline while two coins will qualify the player for two paylines, while up to five coins can qualify the player for five paylines. According to this illustrated embodiment, if a player wagers the maximum amount, then the player becomes eligible to play the secondary game.

FIG. 6 illustrates the payouts of the illustrated embodiments. Illustrated payouts are strictly illustrative and those skilled in the art will appreciate, from the present description, that other payouts can be made without departing from the scope of the present invention.

A player becomes eligible to play the secondary game upon the occurrence of some event. For example, the secondary game can be activated randomly, or upon the occurrence of a particular outcome on the primary gaming unit. In the illustrated embodiment, when a particular indicia appears on the center payline and the player has wagered the maximum of coins allowable, then the player is entitled to play the secondary bowling game. According to the play of the secondary bowling game, a player pushes a button designated as "ROLL THE BOWL" (not shown). Upon pressing that button, three frames of a bowling game are simulated to a player in conjunction with the spinning of a wheel, such as the wheel illustrated in FIG. 7. While the spinning of a wheel is preferred, other types of displays can be utilized to display a randomly selected outcome for the bowling game. According to this illustrated embodiment, three frames are played for each push of the "ROLL THE BALL" button. On the third press of the button, the tenth frame is automatically played for the player, or the player is allowed a fourth push of the "ROLL THE BALL" button. The player's score is most preferably automatically totaled and the player then receives a payout corresponding to the payout schedule illustrated in FIG. 6 for this secondary gaming unit. Thus, according to one embodiment of the present invention, the secondary gaming unit simulates a full bowling game, namely a game comprising ten frames. According to alternative embodiments of the present invention, less than a full bowling game can be provided.

What is claimed is:

1. A method of conducting a game of chance comprising the steps of:

providing a player of with an opportunity to place a wager to activate a primary gaming unit;

said primary gaming unit displaying a randomly selected primary display to a player, said display comprising at least one indicia from a plurality of possible indicia;

providing a secondary gaming unit comprising indicia of a bowling game; and displaying randomly selected indicia of a bowling game with said secondary gaming unit if said primary display comprised a predetermined display.

2. A method of conducting a game of chance according to claim 1 further comprising providing said player with one of a plurality of prizes depending upon the outcome of said secondary gaming unit.

3. A method of conducting a game of chance according to claim 1 wherein said primary gaming unit comprises a plurality of reels.

4. A method of conducting a game of chance according to claim 3 wherein said indicia which determines whether said player can play said secondary gaming unit is only on one of said reels.

5. A method of conducting a game of chance according to claim 4 further comprising a plurality of pay lines.

6. A method of conducting a game of chance according to claim 5 wherein said secondary gaming unit simulates a full bowling game if said indicia appears on a first pay line.

7. A method of conducting a game of chance according to claim 6 less than a full bowling game if said indicia appears on a second pay line.

* * * * *